US010403073B2

(12) United States Patent
Zhang

(10) Patent No.: US 10,403,073 B2
(45) Date of Patent: Sep. 3, 2019

(54) INTELLIGENT LOCK, METHOD FOR OPERATING THE SAME, AND INTELLIGENT SAFE DEPOSIT BOX

(71) Applicant: BOE Technology Group Co., Ltd., Beijing (CN)

(72) Inventor: Xiying Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/015,572

(22) Filed: Jun. 22, 2018

(65) Prior Publication Data

US 2019/0080533 A1 Mar. 14, 2019

(30) Foreign Application Priority Data

Sep. 14, 2017 (CN) ..... 2017 1 0828032

(51) Int. Cl.
*G07C 9/00* (2006.01)
*E05B 39/00* (2006.01)
(Continued)

(52) U.S. Cl.
CPC ..... *G07C 9/0069* (2013.01); *E05B 39/00* (2013.01); *E05B 47/00* (2013.01); *E05B 65/0075* (2013.01); *G07C 9/00563* (2013.01)

(58) Field of Classification Search
None
See application file for complete search history.

(56) References Cited

U.S. PATENT DOCUMENTS

2006/0136315 A1* 6/2006 Muthiki ..... G06Q 30/02 705/35
2014/0294255 A1* 10/2014 Kammer ..... G06K 9/00221 382/118
(Continued)

FOREIGN PATENT DOCUMENTS

CN 103422731 A 12/2013
CN 105243718 A 1/2016
(Continued)

OTHER PUBLICATIONS

Office Action issued in corresponding Chinese Patent Application No. 201710828032.4, dated Jul. 1, 2019.

*Primary Examiner* — Carlos Garcia
(74) *Attorney, Agent, or Firm* — McDermott Will & Emery LLP

(57) ABSTRACT

The present disclosure provides an intelligent lock, a method for operating the same, and an intelligent safe deposit box. The intelligent lock comprises: a mechanical lock body; an identity recognition module configured to acquire identity information of a user; a password input module configured to acquire a password input by the user; a controller electrically connected to the identity recognition module and the password input module, and configured to: determine whether the user is a legitimate user according to the identity information, determine whether the password is consistent with a reference unlocking password, and control a state of the mechanical lock body, wherein the controller controls the mechanical lock body to be in an unlocked state only on condition that it is determined that the user is a legitimate user and the password is consistent with the reference unlocking password.

14 Claims, 3 Drawing Sheets

(51) Int. Cl.
*E05B 47/00* (2006.01)
*E05B 65/00* (2006.01)

(56) References Cited

U.S. PATENT DOCUMENTS

| | | | | |
|---|---|---|---|---|
| 2015/0161837 | A1 | 6/2015 | Smith et al. | |
| 2017/0356218 | A1* | 12/2017 | Beasley | G07C 9/00896 |
| 2018/0046978 | A1* | 2/2018 | Tartal | G06Q 10/0832 |

FOREIGN PATENT DOCUMENTS

| | | | |
|---|---|---|---|
| CN | 105991776 | A | 10/2016 |
| CN | 106127900 | A | 11/2016 |

* cited by examiner

INTELLIGENT LOCK, METHOD FOR OPERATING THE SAME, AND INTELLIGENT SAFE DEPOSIT BOX

CROSS-REFERENCE TO RELATED APPLICATION(S)

This application claims priority to the Chinese Patent Application No. 201710828032.4, filed on Sep. 14, 2017, which is incorporated herein by reference in its entirety.

TECHNICAL FIELD

The present disclosure relates to the security technology, and more particularly, to an intelligent lock, a method for operating the same, and an intelligent safe deposit box.

BACKGROUND

Safe deposit boxes are generally unlocked by simply inputting a password or using only identity recognition, which is easier to crack passwords thereof. For example, unlocking software developed by many high-tech thieves can test combinations of passwords by running a program at a high speed to find out a correct unlocking password in a short period of time, i.e., realizing password cracking in the short period of time. Low-end thieves are more likely to guess the password in a short period of time, i.e., realizing password cracking, even though they manually test each digit of the password. Therefore, there is a very high risk of theft and the security needs to be improved.

SUMMARY

According to an aspect of the present disclosure, there is provided an intelligent lock, comprising: a mechanical lock body; an identity recognition module configured to acquire identity information of a user; a password input module configured to acquire a password input by the user; a controller electrically connected to the identity recognition module and the password input module, and configured to: determine whether the user is a legitimate user according to the identity information, determine whether the password is consistent with a reference unlocking password, and control a state of the mechanical lock body, wherein the controller controls the mechanical lock body to be in an unlocked state only on condition that it is determined that the user is a legitimate user and the password is consistent with the reference unlocking password.

In an embodiment, the intelligent lock operates in one of a collection mode and a recognition mode, wherein in the collection mode, the controller is configured to store the acquired identity information in a memory of the intelligent lock as pre-stored identity information, and in the recognition mode, the controller is configured to compare the acquired identity information with the pre-stored identity information, and determine whether the user is a legitimate user according to a comparison result.

In an embodiment, the identity information is one of card reading information, fingerprint information, iris information, face recognition information, and voice feature information.

In an embodiment, the controller is further configured to set the reference unlocking password to be a random password when it is determined that the user is not a legitimate user or that the identity information has not been acquired but the password has been acquired.

In an embodiment, the controller is further configured to: when first M digits of the password are acquired, set the reference unlocking password to be a random password, where M is greater than or equal to 1 and less than a total number of digits of the reference unlocking password.

In an embodiment, the controller is further configured to set the reference unlocking password to be an original unlocking password when it is determined that the user is a legitimate user.

In an embodiment, the intelligent lock further comprises an alert module configured to provide an alert when receiving an alert instruction from the controller, wherein the controller is further configured to transmit the alert instruction to the alert module when it is determined that the user is not a legitimate user or that the identity information has not been acquired but the password has been acquired.

According to another aspect of the present disclosure, there is provided an intelligent safe deposit box, comprising the intelligent lock according to any embodiment described above.

In an embodiment, the intelligent safe deposit box further comprises a proximity sensor electrically connected to the intelligent lock and configured to detect a distance between the user and the intelligent safe deposit box, and trigger the identity recognition module in the intelligent lock to acquire the identity information of the user on condition that the distance is less than a predetermined distance.

In an embodiment, the identity recognition module of the intelligent lock is imperceptible by the user.

According to another aspect of the present disclosure, there is provided a method for operating the intelligent lock according to any embodiment described above, comprising: acquiring identity information; acquiring a password input by a user; determining whether the user is a legitimate user according to the identity information; determining whether the password is consistent with a reference unlocking password; and controlling a state of the mechanical lock body, wherein the intelligent lock controls the mechanical lock body to be in an unlocked state only on condition that it is determined that the user is a legitimate user and the password is consistent with the reference unlocking password.

In an embodiment, the intelligent lock operates in one of a collection mode and a recognition mode, the method further comprising: in the collection mode, storing the acquired identity information as pre-stored identity information, and in the recognition mode, comparing the acquired identity information with the pre-stored identity information, and determining whether the user is a legitimate user according to a comparison result.

In an embodiment, the identity information is one of card reading information, fingerprint information, iris information, face recognition information, and voice feature information.

In an embodiment, the method further comprises: setting the reference unlocking password to be a random password when it is determined that the user is not a legitimate user or that the identity information has not been acquired but the password has been acquired.

In an embodiment, the step of setting the reference unlocking password to be a random password comprises: when first M digits of the password are acquired, setting the reference unlocking password to be a random password, where M is greater than or equal to 1 and less than a total number of digits of the reference unlocking password.

In an embodiment, the method further comprises: setting the reference unlocking password to be an original unlocking password when it is determined that the user is a legitimate user.

In an embodiment, the method further comprises: providing an alert when it is determined that the user is not a legitimate user or that the identity information has not been acquired but the password has been acquired.

Other features and advantages of the present disclosure will be set forth in the description which follows, and in part will be obvious from the description, or may be learned by practice of the present disclosure. The purposes and other advantages of the present disclosure may be realized and obtained by the structure particularly pointed out in the description, the claims and the accompanying drawings.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings are used to provide a further understanding of the technical solutions of the present disclosure and constitute a part of the description. The accompanying drawings are used together with the embodiments of the present application to explain the technical solutions of the present disclosure and do not constitute limitations on the technical solutions of the present disclosure.

DETAILED DESCRIPTION

In order to make the purposes, technical solutions, and advantages of the present disclosure more clear, the embodiments of the present disclosure will be described in detail below with reference to the accompanying drawings. It should be illustrated that, the embodiments in the present application and the features in the embodiments can be combined with each other randomly without a conflict.

Steps illustrated in the flowcharts of the accompanying drawings may be performed in a computer system such as a set of computer-executable instructions. Further, although a logical order is shown in the flowcharts, in some cases, the illustrated or described steps may be performed in an order other than that here.

Unless otherwise defined, technical terms or scientific terms used in the present disclosure should have the same meanings as those commonly understood by those of ordinary skill in the art to which the present disclosure belongs. The use of words such as "first", "second", etc. in the present disclosure does not denote any order, quantity, or importance, but merely serves to distinguish between different components. The use of words such as "including" or "comprising" etc. means that the presence of an element or item preceding the word encompasses elements or items listed after the word and their equivalents, without excluding other elements or items. The words such as "connected to" or "connected with" etc. are not limited to physical or mechanical connections, but may comprise electrical connections, regardless of direct connections or indirect connections. "Up", "down", "left", "right" etc. are only used to represent relative positional relationships. When an absolute position of an object described is changed, the relative positional relationship may also be changed accordingly.

Figure 1:
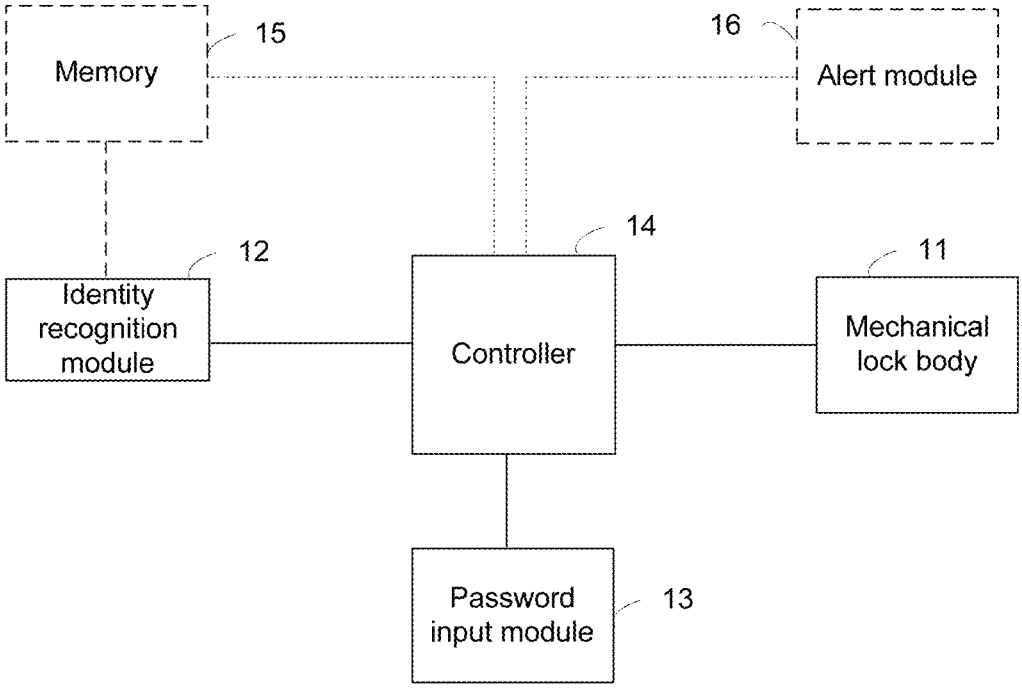
FIG. 1 is a structural block diagram of an intelligent lock according to an embodiment of the present disclosure.

FIG. 1 is a structural block diagram of an intelligent lock according to an embodiment of the present disclosure.

As shown in FIG. 1, the intelligent lock comprises: a mechanical lock body 11, an identity recognition module 12, a password input module 13 and a controller 14.

The mechanical lock body 11 can be known with reference to conventional designs. For example, the mechanical lock body 11 may comprise a control motor, a transmission mechanism driven by the control motor, and a lock tongue controlled by the transmission mechanism. The control motor may drive the transmission mechanism to control movement of the lock tongue so that the lock tongue is in a locked or unlocked state. Specific implementations can be known with reference to general coded locks, which will not be repeated here.

The identity recognition module 12 is configured to acquire identity information of a user.

In an embodiment, the identity information may be card reading information, fingerprint information, iris information, face recognition information, voice feature information etc.

The password input module 13 is configured to acquire a password input by the user.

In an embodiment, the password input module 13 comprises a panel for the user to input a password, which may be a touch screen or be of a push-button type. The password to be input may be numbers or may also comprise letters.

The controller 14 is electrically connected to the identity recognition module 12 and the password input module 13, and receives the identity information and the password from the identity recognition module 12 and the password input module 13. The controller 14 is configured to determine whether the user is a legitimate user according to the identity information, determine whether the password is consistent with a reference unlocking password, and control a state of the mechanical lock body 11. The controller 14 controls the mechanical lock body 11 to be in an unlocked state only on condition that it is determined that the user is a legitimate user and the password is consistent with the reference unlocking password.

In an embodiment, a method of determining whether the user is a legitimate user comprises comparing the acquired identity information with pre-stored identity information, and determining whether the user is a legitimate user according to a comparison result. If the acquired identity information is consistent with the pre-stored identity information, the user is a legitimate user; otherwise, the user is an illegitimate user.

The intelligent lock according to the present embodiment can be unlocked only when the identity recognition passes and a correct unlocking password is input. When the identity recognition does not pass, or when the identity recognition passes but the password is wrong, the intelligent lock cannot be unlocked. The intelligent lock has higher security than that of a simple fingerprint lock or coded lock.

In an embodiment, the coded lock may further comprise a memory 15. The memory 15 is configured to pre-store identity information of legitimate users.

The intelligent lock operates in one of a collection mode and a recognition mode. In the collection mode, the controller is configured to store the acquired identity information in the memory of the intelligent lock as pre-stored identity information. In the recognition mode, the controller is configured to compare the acquired identity information with the pre-stored identity information, and determine whether the user is a legitimate user according to a comparison result.

In an embodiment, the controller 14 controls a state of the mechanical lock body 11 based on both the identity information and the password. For example, the controller may determine whether the user is a legitimate user according to the identity information and determine whether the password is a pre-stored reference unlocking password. There are 2×2=4 results for a combination of the two determination processes. In general, the controller 14 may assign different states of the mechanical lock body 11 to the 4 results. For example, as described above, the controller 14 controls the mechanical lock body 11 to be in an unlocked state only if both of the two determination processes have positive results.

In another embodiment, the controller 14 controls the state of the mechanical lock body 11 only based on the input password. In this embodiment, the controller 14 firstly determines whether the user is a legitimate user using the identity information, and sets a reference unlocking password to be compared with the input password based on a determination result. Then, the controller 14 compares the password input by the user with the set reference unlocking password, and thereby controls the state of the mechanical lock body 11 based on the input password.

In an embodiment, the controller 14 sets the reference unlocking password to be an original unlocking password when it is determined that the user is a legitimate user.

In an embodiment, the controller 14 sets the reference unlocking password to be a random password when it is determined that the user is not a legitimate user (or the identity information has not been acquired but the password has been acquired). In an embodiment, the random password is generated on the fly by the controller 14 using a random number generator. In another embodiment, a password with a specific rule may also be used instead of the random password. For example, the reference unlocking password may be generated by adding each digit with 1 as a transformed digit. It should be illustrated that the password is not limited to numbers.

In an embodiment, the controller 14 starts to set the reference unlocking password or first M digits thereof when the first M digits of the password (where M is greater than or equal to 1 and less than a total number of digits of the reference unlocking password) are acquired through the password input module, instead of setting the reference unlocking password or the first M digits thereof after acquiring the entire sequence of the password. As a result, illegitimate users cannot input the correct unlocking password at all.

For example, by taking the unlocking password being 6 digits and M being 4 as an example, if the user has input first 4 digits of the preset unlocking password, the unlocking password or the first 4 digits of the unlocking password are set at this time.

In addition, the unlocking password may be transformed many times. For example, if an illegitimate user correctly inputs the first 4 digits of the unlocking password, the unlocking password is transformed for a first time. If the illegitimate user subsequently inputs first 4 digits of the unlocking password which has been transformed for the first time again, the unlocking password may be transformed for a second time.

Of course, in other embodiments, the controller 14 may ignore a password input by a current user when it is determined that the user is an illegitimate user or identity information has not been received, that is, the password input by the current user is directly discarded. As a result, the illegitimate user cannot input the password, and thus cannot unlock the intelligent lock.

In an embodiment, the intelligent lock may further comprise an alert module 16. The alert module 16 is configured to provide an alert after receiving an alert instruction from the controller. At this time, the controller 14 is further configured to transmit an alert instruction to the alert module 16 when it is determined that the user is not a legitimate user or that the identity information has not been acquired but the password has been acquired.

In an embodiment, when the identity information has not been received, the controller 14 may transmit an instruction to the alert module 16 when the password input module 13 detects that a user inputs a first digit of a password, or may transmit an instruction to the alert module 16 after it is detected that the user inputs multiple digits of the password. For example, a set platform is a security platform, such as a community security platform, or a platform for calling the police, etc. For example, a set user is a legitimate user of the intelligent lock.

Figure 2:
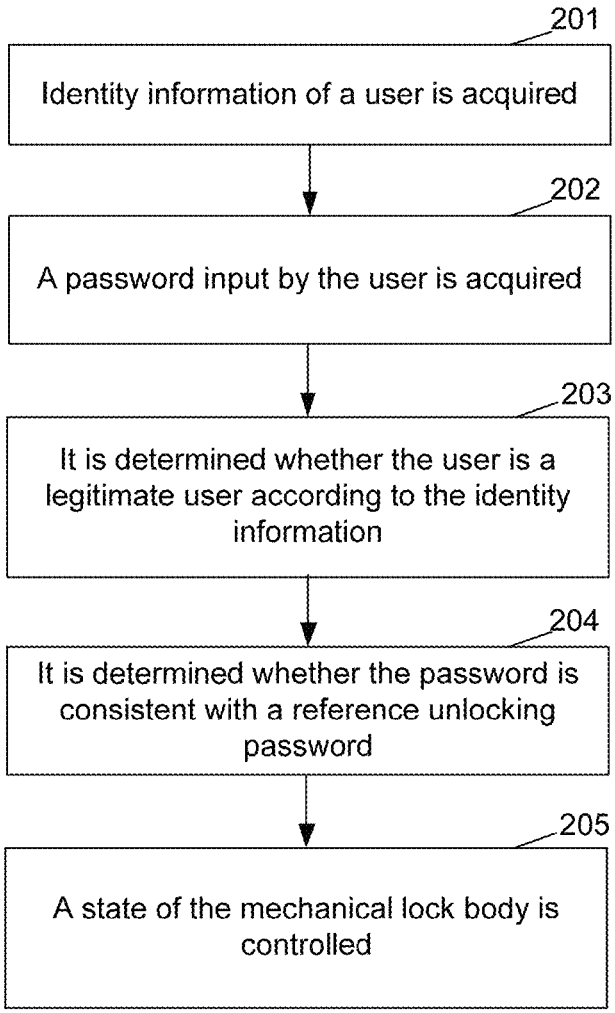
FIG. 2 is a flowchart of a method for operating an intelligent lock according to an embodiment of the present disclosure.

FIG. 2 is a flowchart of a method for operating an intelligent lock according to an embodiment of the present disclosure. The method may be a method for operating the intelligent lock shown in FIG. 1. Therefore, the description and explanation made above in connection with FIG. 1 are also applicable here and will not be repeated.

As shown in FIG. 2, the method comprises the following steps.

In step 201, identity information of a user is acquired.

In step 202, a password input by the user is acquired.

In step 203, it is determined whether the user is a legitimate user according to the identity information.

In step 204, it is determined whether the password is consistent with a reference unlocking password.

In step 205, a state of the mechanical lock body is controlled.

The intelligent lock controls the mechanical lock body to be in an unlocked state only on condition that it is determined that the user is a legitimate user and the password is consistent with the reference unlocking password.

In an embodiment, the intelligent lock operates in one of a collection mode and a recognition mode, the method further comprising: in the collection mode, storing the acquired identity information as pre-stored identity information, and in the recognition mode, comparing the acquired identity information with the pre-stored identity information, and determining whether the user is a legitimate user according to a comparison result.

In an embodiment, the identity information is one of card reading information, fingerprint information, iris information, face recognition information, and voice feature information.

In an embodiment, the method further comprises: setting the reference unlocking password to be a random password when it is determined that the user is not a legitimate user or that the identity information has not been acquired but the password has been acquired.

In an embodiment, the step of setting the reference unlocking password to be a random password comprises: when first M digits of the password are acquired, setting the reference unlocking password to be a random password, where M is greater than or equal to 1 and less than a total number of digits of the reference unlocking password.

In an embodiment, the method further comprises: setting the reference unlocking password to be an original unlocking password when it is determined that the user is a legitimate user.

In an embodiment, the method further comprises: providing an alert when it is determined that the user is not a legitimate user or that the identity information has not been acquired but the password has been acquired.

The intelligent lock according to the above embodiments of the present disclosure may be applied to security devices such as intelligent safe deposit boxes etc. When the intelligent lock is in an unlocked state, the intelligent safe deposit box is opened and articles may be taken in and out of the intelligent safe deposit box. When the intelligent lock is in a locked state, the intelligent safe deposit box is closed and articles cannot be taken in and out of the intelligent safe deposit box.

In an embodiment, the identity recognition module may be provided at a hidden position of the intelligent safe deposit box. That is, the identity recognition module is placed at a position which is imperceptible or is not easy to perceive, so that thieves mistakenly believe that the intelligent safe deposit box is a conventional locked safe deposit box. In a process of performing password cracking by a thief, the intelligent safe deposit box transmits an alert to a set user (such as an owner) or call the police, which is advantageous for capturing the thief. In particular, the solution of setting different reference unlocking passwords according to the user identity in the above embodiments can make the thief mistakenly believe that his/her own decoding operation is erroneous in a case of correct decoding, and may not perceive that the act of theft has been detected.

It should be illustrated that the intelligent lock is not only applied to an intelligent safe deposit box, but also to other devices which require a lock. For example, the intelligent lock is used as a door lock, a device lock, etc.

The present application will be further described by taking an instance as an example.

Figure 3:
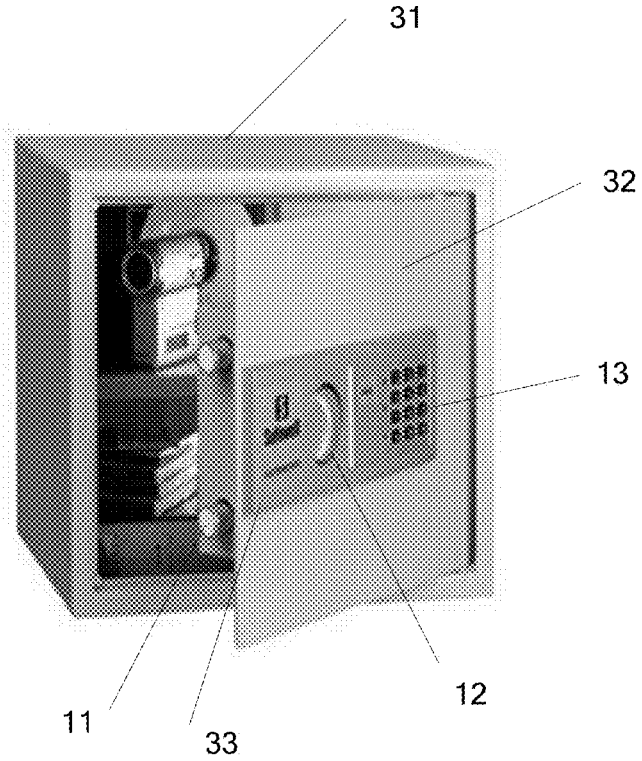
FIG. 3 is a schematic diagram of an intelligent safe deposit box according to an embodiment of the present disclosure.

FIG. 3 is a schematic diagram of an intelligent safe deposit box. As shown in FIG. 3, the intelligent safe deposit box comprises a box body 31, a box door 32 connected to the box body 31, and an intelligent lock 33. The intelligent lock is partly provided on the box body 31 and is partially provided on the box door 32. The intelligent lock 33 comprises a mechanical lock body 11 (only a lock tongue portion of the mechanical lock body 11 is shown in FIG. 3), an identity recognition module 12, a password input module 13, a controller 14 (not shown in FIG. 3), a memory 15 (not shown in FIG. 3) etc. The identity recognition module 12 collects identity information based on fingerprint information, and the memory 15 pre-stores fingerprint information of owners (i.e., legitimate users, wherein there may be one or more legitimate users.) During use, a user firstly needs to perform identity recognition through the identity recognition module 12, and then inputs a password through the password input module 13. When the intelligent lock is in an unlocked state, the door 32 of the intelligent safe deposit box is opened, and articles may be taken in and out of the intelligent safe deposit box. When the intelligent lock is in a locked state, the door 32 of the intelligent safe deposit box is closed and it is impossible to take articles in and out from the intelligent safe deposit box.

The controller 14 executes a process of determining the identity information and the password. If the password input by the user is a preset unlocking password, the lock is unlocked. If the password input by the user is not the preset unlocking password, the lock is maintained in a locked state. In addition, a number of trial and error times may be set. If a wrong password is input many times, the lock enters a protected state, and cannot be unlocked by cracking the password. The lock can be released from the protected state only in a certain way, for example, the lock may be released from the protected state using a special device of a manufacturer of the intelligent lock etc.

When the controller 14 determines that the current user is not a legitimate user, the current user is determined to be a thief, and the controller 14 automatically transforms (for example, randomly transforms) first M digits of the safe deposit box after the thief correctly inputs the first M digits of the unlocking password (where M is greater than or equal to 1 and less than or equal to a number of digits of the current unlocking password.) At this time, the unlocking password has been changed, and even if the thief correctly guesses last few digits of the password, the lock cannot be unlocked. At this time, the transformed password is completely random, and is not known by the real owner. Only after identity recognition of the owner is successfully performed, the transformed password can be restored to the unlocking password which is initially set. In addition, when the user directly inputs a password without identity recognition, processing of the intelligent safe deposit box is the same as that of recognizing that the user is not a legitimate user, and will not be repeated here.

The use of the intelligent safe deposit box will be described below by taking the unlocking password being 123456 and M being 3 as an example.

When it is detected that the current user is a legitimate user through the identity recognition, and the received password which is input by the user is 123456, unlocking is performed.

Figure 4:
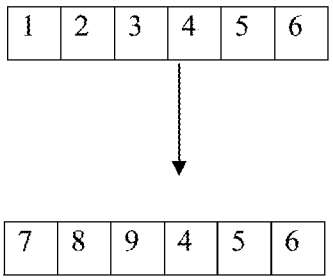
FIG. 4 is a schematic diagram of a password for unlocking an intelligent safe deposit box according to an embodiment of the present disclosure.

When it is determined that the current user is an illegitimate user or the user starts to input a password without identity recognition, it is determined that the user is a thief, and the thief starts to try to crack the password from a first digit of the password, i.e., starting to guess the password. It is assumed that first three digits of the password input by the thief are correct, that is, the first three digits 123 of the password are correctly guessed, when the thief inputs a fourth digit of the password, the first three digits of the unlocking password are automatically changed to, for example, 789. At this time, the unlocking password becomes 789456, as shown in FIG. 4. In this case, even if the user correctly guesses last three digits 456, the intelligent safe deposit box cannot be opened. It should be illustrated that when the unlocking password is changed, only one or two of the first three digits may be changed or all the three digits may be changed. In addition, when the unlocking password is changed, the last few digits of the unlocking password (the last three digits in the present embodiment) may also be changed.

In an embodiment, the identity recognition module 12 is provided at a hidden position of the intelligent safe deposit box (for example, positions such as the side, top, rear, etc. of the intelligent safe deposit box), or the identity recognition module 12 is disguised (by, for example, covering a surface thereof with decorative signs, etc.), so that the identity recognition module is imperceptible by the user or is difficult for the user to perceive. As a result, only the owner himself/herself knows that the safe deposit box has this identity recognition function, which is not known by the thief. In this case, as the identity recognition of the thief is not performed in the password verification process, the intelligent safe deposit box determines that the current user is an illegitimate user and transmits an alert to the owner, and the thief is still trying to crack the password, which is beneficial to the owner to discover the thief and call the police in time.

In another embodiment, the intelligent safe deposit box may further comprise a proximity sensor. The proximity sensor is electrically connected to the intelligent lock and is configured to detect a distance between the user and the intelligent safe deposit box. On condition that the distance is less than a predetermined distance, the proximity sensor triggers the identity recognition module in the intelligent lock to actively acquire the identity information of the user. Of course, this embodiment does not apply to all kinds of identity information (such as card reading information and fingerprint information).

In another embodiment, a camera may further be provided on the intelligent safe deposit box. If the identity recognition of the user is not performed or it is determined that the user is an illegitimate user through the identity recognition, the camera is activated to photograph the user and store the captured image.

As the intelligent safe deposit box according to the present embodiment can be unlocked only when not only identity recognition is successfully performed but also a correct password is input, its security is higher than that of a safe deposit box which is unlocked by simply inputting a password or simply inputting a fingerprint.

It should be illustrated that the accompanying drawings of the embodiments of the present disclosure only relate to the structures related to the embodiments of the present disclosure, and other structures can be known with reference to normal designs.

Although the embodiments of the present disclosure are described as above, the contents described are merely embodiments used for facilitating the understanding of the present disclosure and are not intended to limit the present disclosure. Any person skilled in the art to which the present disclosure pertains can make any modifications and changes in form and details of implementations without departing from the spirit and scope disclosed in the present disclosure, and the patent protection scope of the present disclosure shall still be defined by the scope of the attached claims.

I claim:

1. An intelligent lock, comprising:

a mechanical lock body;

an identity recognition module configured to acquire identity information of a user;

a password input module configured to acquire a password input by the user;

a controller electrically connected to the identity recognition module and the password input module, and configured to:

determine whether the user is a legitimate user according to the identity information, determine whether the password is consistent with a reference unlocking password, and control a state of the mechanical lock body, wherein the controller controls the mechanical lock body to be in an unlocked state only on condition that it is determined that the user is a legitimate user and the password is consistent with the reference unlocking password, wherein the controller is further configured to, on condition that it is determined that the user is not a legitimate user or that the identity information has not been acquired, set the reference unlocking password to be a random password when first M digits of the password have been acquired by the password input module, wherein M is greater than or equal to 1 and less than a total number of digits of the reference unlocking password.

2. The intelligent lock according to claim 1, wherein the intelligent lock operates in one of a collection mode and a recognition mode, wherein in the collection mode, the controller is configured to store the acquired identity information in a memory of the intelligent lock as pre-stored identity information, and in the recognition mode, the controller is configured to compare the acquired identity information with the pre-stored identity information, and determine whether the user is a legitimate user according to a comparison result.

3. The intelligent lock according to claim 1, wherein the identity information is one of card reading information, fingerprint information, iris information, face recognition information, and voice feature information.

4. The intelligent lock according to claim 1, wherein the controller is further configured to set the reference unlocking password to be an original unlocking password when it is determined that the user is a legitimate user.

5. The intelligent lock according to claim 1, further comprising an alert module configured to provide an alert when receiving an alert instruction from the controller, wherein the controller is further configured to transmit the alert instruction to the alert module when it is determined that the user is not a legitimate user or that the identity information has not been acquired but the password has been acquired.

6. An intelligent safe deposit box, comprising the intelligent lock according to claim 1.

7. The intelligent safe deposit box according to claim 6, further comprising a proximity sensor electrically connected to the intelligent lock and configured to detect a distance between the user and the intelligent safe deposit box, and trigger the identity recognition module in the intelligent lock to acquire the identity information of the user on condition that the distance is less than a predetermined distance.

8. The intelligent safe deposit box according to claim 6, wherein the identity recognition module of the intelligent lock is imperceptible by the user.

9. An intelligent safe deposit box, comprising the intelligent lock according to claim 4.

10. A method for operating the intelligent lock according to claim 1, comprising:

acquiring identity information of a user;

acquiring a password input by the user;

determining whether the user is a legitimate user according to the identity information;

determining whether the password is consistent with a reference unlocking password; and controlling a state of the mechanical lock body, wherein the intelligent lock controls the mechanical lock body to be in an unlocked state only on condition that it is determined that the user is a legitimate user and the password is consistent with the reference unlocking password, wherein the method further comprises:

on condition that it is determined that the user is not a legitimate user or that the identity information has not been acquired, setting the reference unlocking password to be a random password when first M digits of the password have been acquired by the password input module, wherein M is greater than or equal to 1 and less than a total number of digits of the reference unlocking password.

11. The method according to claim 10, wherein the intelligent lock operates in one of a collection mode and a recognition mode, the method further comprising:

in the collection mode, storing the acquired identity information as pre-stored identity information, and in the recognition mode, comparing the acquired identity information with the pre-stored identity information, and determining whether the user is a legitimate user according to a comparison result.

12. The method according to claim 10, wherein the identity information is one of card reading information, fingerprint information, iris information, face recognition information, and voice feature information.

13. The method according to claim 10, further comprising: setting the reference unlocking password to be an original unlocking password when it is determined that the user is a legitimate user.

14. The method according to claim 10, further comprising:

providing an alert when it is determined that the user is not a legitimate user or that the identity information has not been acquired but the password has been acquired.

* * * * *